US005107254A

United States Patent [19]

Choi

[11] Patent Number: 5,107,254

[45] Date of Patent: Apr. 21, 1992

[54] ADDRESS PRODUCING CIRCUIT FOR ZOOM FUNCTION

[75] Inventor: Hoon-Sun Choi, Seoul. Rep. of Korea

[73] Assignee: SamSung Electronics Co., Ltd., Suwon, Rep. of Korea

[21] Appl. No.: 377,965

[22] Filed: Jul. 11, 1989

[30] Foreign Application Priority Data

Jul. 11, 1988 [KR] Rep. of Korea ..... 1988-8616[U]

[51] Int. Cl.[5] ..... G09G 1/06

[52] U.S. Cl. ..... 340/731; 340/723; 358/180; 382/47

[58] Field of Search ..... 340/731, 723, 732, 749, 340/814; 382/47, 56; 358/180, 22

[56] References Cited

U.S. PATENT DOCUMENTS

| | | | |
|---|---|---|---|
| 4,754,270 | 6/1988 | Murauchi | 340/731 |
| 4,757,311 | 7/1988 | Nakamura et al. | 340/731 |
| 4,774,581 | 9/1988 | Shiratsuchi | 382/47 |
| 4,821,031 | 4/1989 | Roberts | 340/731 |
| 4,952,923 | 8/1990 | Tamura | 340/731 |

*Primary Examiner*—Ulysses Weldon
*Assistant Examiner*—M. Fatahiyar
*Attorney, Agent, or Firm*—Bushnell, Robert E.

[57] ABSTRACT

Disclosed is an address producing circuit for zoom function in which horizontal and vertical addresses are to make more free selection of a partial picture around a plurality of locations disposed on a screen of a monitor device, and image data stored in a predetermined address region according to the selection is read out to display on the screen, so that the picture of the selected partial region can be magnified to a whole screen picture.

24 Claims, 2 Drawing Sheets

ADDRESS PRODUCING CIRCUIT FOR ZOOM FUNCTION

BACKGROUND OF THE INVENTION

The present invention relates to an image processing system of digital method having a zoom function for magnifying a picture of a partial region of a single frame displayed on a monitor screen to a whole sized screen, and particularly to a circuit for controlling a picture of a desired partial region to magnify, according to selection of an operator.

Usually, the operation of a digital image processing system includes steps of storing temporarily an image data of one field amount to a field memory, reading out the image data stored in the memory, and thereafter converting the data into an analog image signal to display on a monitor screen through a monitor driver. The zoom function means, in the art, a pictorial operation magnifying a picture of a partial region of one frame displayed on the screen of a monitor to a full-sized picture of one frame. In order to carry out such a function, the digital image processing system reads out image data stored in an address corresponding to a selected partial area of total image data in field memory, converts the read-out data to an analog image signal, thereafter outputting to a monitor through a monitor driver, by which it becomes magnified to a full-size screen on the monitor. However, a conventional zoom function as shown in FIG. 1, has a drawback that selection of a desired picture portion to magnify is considerably limited because it is constructed so as to be operated by magnifying selectively the partial picture around only five fixed locations.

OBJECT OF THE INVENTION

Therefore, it is an object of the present invention to provide an address producing circuit for a zoom function in which horizontal and vertical addresses are provided to make more free selection of a partial picture around a plurality of locations disposed on a screen of monitor device, and image data stored in a predetermined address region according to the selection is read out to display on the screen, so that the picture of the selected partial region can be magnified to a whole screen picture.

According to one aspect of the invention, the address producing circuit for the zoom function includes a: micro-processor for controlling and processing image data; command decoder for producing a zoom control signal and first and second zoom-position selection data by receiving and thereafter decoding a zoom command and zoom-position data from said micro-processor; first multiplexer for inputting a plurality of row addresses, and thereby outputting a row address selected of said plurality of row addresses in response to a logic state of the first zoom-position selection data applied from said command decoder; second multiplexer for inputting a plurality of column addresses, and thereby outputting a column address selected of said plurality of column addresses in response to a logic state of the second zoom-position selection data applied from said command decoder; third multiplexer for inputting a color sub-carrier signal and its frequency-divided signal from the frequency divider, to thereby output either one of the color sub-carrier or said frequency divided signal thereof in response to the logic state of the zoom control signal; fourth multiplexer for inputting a horizontal synchronizing signal and its frequency-divided signal from the frequency divider, to thereby output either one of the horizontal synchronizing signal or said frequency divided signal in response to the logic state of the zoom control signal; vertical counter for inputting the output of said first multiplexer in accordance with a vertical synchronizing signal applied from the frequency divider through a load terminal, and thereby outputting to the field memory row-address data, by adding a numeral "1" to data provided from said first multiplexer whenever the horizontal synchronizing signal or said its frequency-divided signal is received to a clock terminal from said fourth multiplexer; and horizontal counter for inputting the output of said second multiplexer in accordance with a horizontal synchronizing signal applied from the frequency divider through a load terminal, and thereby outputting to the field memory column-address data, by adding a numeral "1" to data provided from said second multiplexer whenever the color sub-carrier signal or said its frequency-divided signal is received to a clock terminal from said third multiplexer.

BRIEF DESCRIPTION OF THE DRAWINGS

For a better understanding of the invention, and to show how the same may be carried out into effect, reference will now be made, by way of example, to the accompanying drawings, in which.

DESCRIPTION OF THE PREFERRED EMBODIMENT

Figure 2:
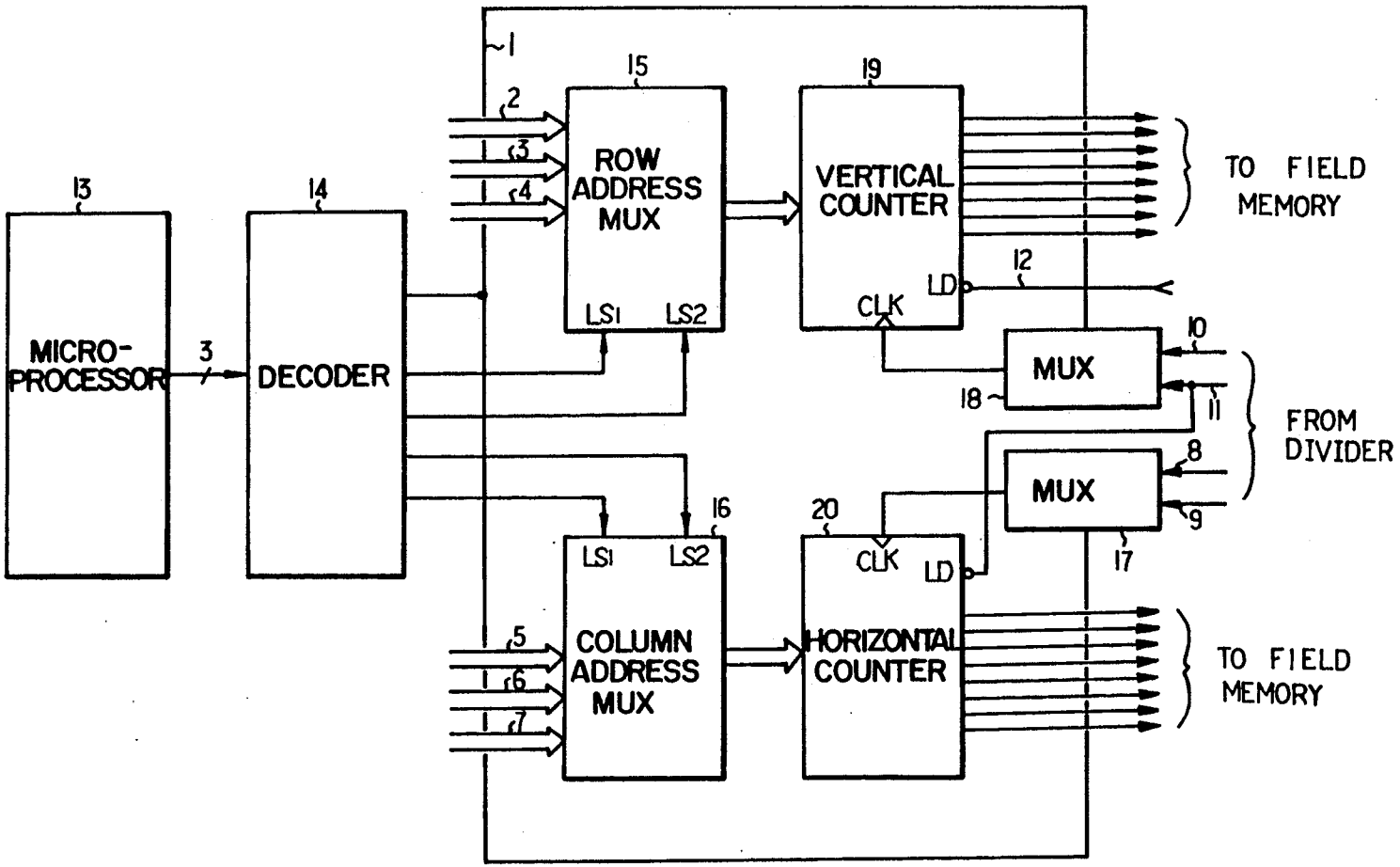
FIG. 2 is a block diagram of a preferred embodiment of the present invention.

Referring to FIG. 2, in an image processing system having a field memory (not shown) and a frequency divider (not shown), an address producing circuit for zoom function according to the present invention includes micro-processor 13 for controlling and processing image data. A command decoder 14 produces a zoom control signal and first and second zoom-position selection data by receiving and thereafter decoding a zoom command and zoom-position data from said micro-processor 13. A first multiplexer 15 inputs a plurality of row addresses, and thereby outputs a row address selected of said plurality of row addresses in response to the logic state of the first zoom-position selection data applied from said command decoder 14. A second multiplexer 16 inputs a plurality of column addresses, and thereby outputs a column address selected of said plurality of column addresses in response to the logic state of the second zoom-position selection data applied from said command decoder 14. A third multiplexer 17 inputs a color sub-carrier signal and its frequency-divided signal from the frequency divider, to thereby output either one of the color sub-carrier or said frequency divided signal thereof in response to the logic state of the zoom control signal. A fourth multiplexer 18 inputs a horizontal synchronizing signal and its frequency-divided signal from the frequency divider, to thereby output either one of the horizontal synchronizing signal or said frequency divided signal in response to the logic state of the zoom control signal. A vertical counter 19 inputs the output of said first multiplexer 15 in accordance with a vertical synchronizing signal 12 applied from the frequency divider through a load terminal LD, and thereby outputs to the field memory row-address data, by adding a numeral "1" to data provided from said first multiplexer 15 whenever the horizontal synchronizing signal or its frequency-divided signal is received at clock terminal CLK from said fourth multiplexer 18. A horizontal counter 20 inputs the output of said second multiplexer 16 in accordance with a horizontal synchronizing signal applied from the frequency divider through a load terminal LD, and thereby outputs to the field memory a column-address data, by adding a numeral "1" to data provided from said second multiplexer 16 whenever the color sub-carrier signal or its frequency-divided signal is received to a clock terminal CLK from said third multiplexer.

Figure 1:
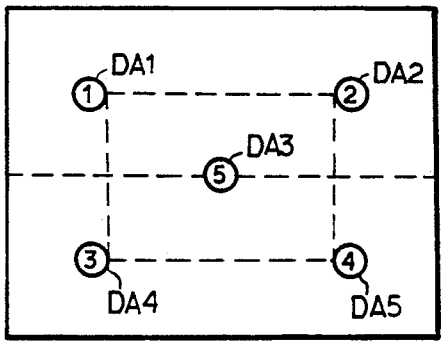
FIG. 1 a schematic diagram showing arrangement of central points of partial regions to be magnified in zoom function according to a known art.
Figure 3A:
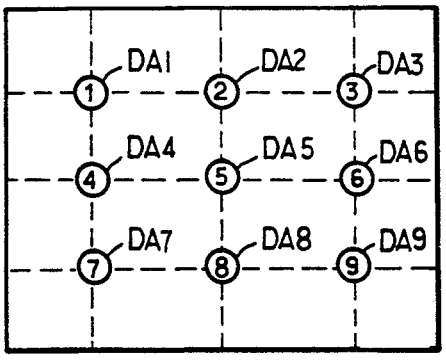
FIG. 3 is a schematic diagram showing arrangements of central points and start points of partial regions to be magnified in zoom function according to the inventive circuit of the FIG. 2.
Figure 3B:
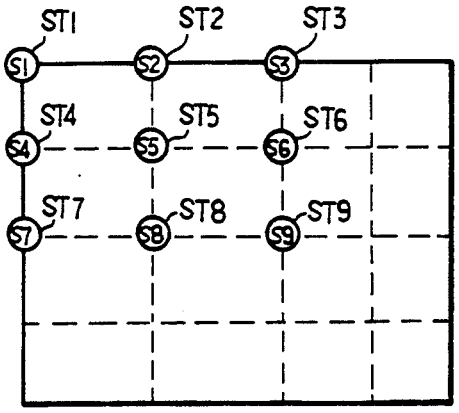

Referring to FIG. 3, the left-sided view is a schematic diagram showing arrangement of central points of a plurality of partial regions to select and magnify on the screen of a monitor in case that the frequencies of the horizontal synchronizing signal and the color sub-carrier are made to be a half of their original frequencies applied, and the right-sided view is a schematic diagram showing various locations of the start points with respect to the left-sided view.

Hereinafter, the operation of the preferred embodiment circuit according to the present invention will be described in detail with reference to FIGS. 2 and 3. At first, assuming that there are three row-addresses and three column-addresses, that are of different values relative to each other, in the first and second multiplexers 15,16, that the color sub-carrier (Fsc) and its divided-by-2 frequency sub-carrier (hereinafter designated as FSC/2) are inputted to the third multiplexer 17, and that the horizontal synchronizing signal and its divided-by-2 frequency horizontal synchronizing signal (hereinafter designated as HSYN/2) are inputted to fourth multiplexer 18, a size of a partial screen which may be magnified to a full size of the monitor screen becomes a region corresponding to ¼ of that of the monitor screen. When a start point of a partial screen to magnify is set by row address and column address, the partial screen and its central point for magnifying the full screen of the monitor will be shown as in FIG. 3.

Then, microprocessor 13, when information with respect to the zoom function and a desired partial region to be magnified on the monitor screen are inputted thereto upon reception of a given television broadcasting program, produces a zoom functional command and zoom position data, thereby synchronizing to clock pulse and transferring to command decoder 14 in a series form, and then applies a strobe signal to the command decoder 14. At this moment, the command decoder 14 inputted with the zoom functional command and zoom position data by the clock pulse and strobe signal from the microprocessor 13, decodes the zoom functional command and zoom position data to thereby produce a zoom control signal from the zoom functional command, and also to produce first and second position selection data from the zoom position data. Thus, the zoom control signal outputs through line 1 to the third and fourth multiplexer 17, 18, the first position selection data to the first multiplexer 15, and the second zoom position selection data to the second multiplexer 16, respectively.

First multiplexer 15 receiving the preset row addresses having respectively different values through three bus lines 2–4, selects a row address of the preset row addresses designated by the first zoom position selection data, according to the logic state of two bits of the first zoom position selection data applied to the two selection terminals LS1, LS2 from command decoder 14, and thereby outputs to the input port of the vertical counter 19. And, the second multiplexer 16 also receiving two bits of second zoom position selection data from said command decoder 14 to its selection terminals LS3, LS4 selects a column address of the preset column addresses of different value through three bus lines 5–7, in accordance with the logic state of the second zoom position selection data, and thereafter outputs to the input port of horizontal counter 20.

On the other hand third multiplexer 17 receiving the zoom control signal to its selection terminal from said command decoder 14 through the line 1, selects either one of the two color sub-carriers Fsc and Fsc/2 inputted respectively to the two input terminals from the frequency divider through two lines 8, 9, according to the logic state of the zoom control signal, and thereafter outputs to the clock terminal of horizontal counter 20. The fourth multiplexer 18 also receiving the two horizontal synchronizing signals HSYN and HSYN/2 respectively to the input terminals from the frequency divider through two lines 11, 10 selects either one of the two inputs in accordance with the logic state of the zoom control signal to its selection terminal through line 1 from command decoder 14, and thereafter outputs to the clock terminal of vertical counter 19.

Then, the vertical counter 19 receives the selected row address (i.e., one of the three row addresses) applied to the input port from first multiplexer 15 during a time period corresponding to a blanking interval of the vertical synchronizing signal applied to the load terminal LD from the frequency divider through the line 12, and thereafter adds a numeral "1" to the selected row address at every time that the signal HSYN/2 is applied to the clock terminal from said fourth multiplexer 18 during the vertical scanning period. And it produces a row address changed by a numeral "1" at every two successive horizontal scanning intervals, and then outputs to the field memory through the output port.

In the meanwhile, the horizontal counter 20 receives the selected column address (i.e., one of the three column addresses) applied to the input port from second multiplexer 16 during a time period corresponding to the blanking interval of the horizontal synchronizing signal applied to the load terminal LD from the frequency divider through the line 11, and thereafter adds a numeral "1" to the preset column address at every time that the signal Fsc/2 is applied to the clock terminal from third multiplexer 17 during the horizontal scanning period. In addition, it produces a row address increased by a numeral "1" at every two successive periods of the color sub-carrier signal, and then outputs to the field memory through the output port. Then the field memory reads out, throughout a time period of one field, the image data stored in an address area corresponding to one-fourth (¼) of the full screen in accordance with the column and row addresses of the horizontal and vertical counters 20 and 19, in which the reading-out operation of said image data may be carried out at every two successive horizontal scanning periods and at every two periods of the color sub-carrier.

Additionally, the start points of FIG. 3 are determined by preset row addresses and column addresses, which are shown by the following table.

TABLE

| | | Column Addresses | | |
|---|---|---|---|---|
| | | First | Second | Third |
| Row Addresses | First | ST1(DA1) | ST2(DA2) | ST3(DA3) |
| | Second | ST4(DA4) | ST5(DA5) | ST6(DA6) |
| | Third | ST7(DA7) | ST8(DA8) | ST9(DA9) |

In the above table, "ST" is used to designate start points of FIG. 3, and "DA" is used to designate various center points of the partial regions to be magnified according to zoom function of the present invention.

As described above, the present invention has an advantage that the number of selections of partial screen regions to magnify upon application of the zoom function may be extended, since it is possible to provide for the first and second multiplexers a plurality of preset row addresses and preset column addresses having different values from each other to select therefrom a each desired address, and further control a counting period of horizontal and vertical counters.

What is claimed is:

1. In an image processing system having a field memory and a frequency divider, an address producing circuit for zoom function comprising:

micro-processor means for controlling and processing image data;

command decoder means for producing a zoom control signal and first and second zoom-position selection data by receiving and thereafter decoding a zoom command and zoom-position data from said micro-processor means;

first multiplexer means for receiving a plurality of row addresses, and providing a row address selected from said plurality of row addresses in response to a logic state of the first zoom-position selection data from said command decoder means;

second multiplexer means for receiving a plurality of column addresses, and providing a column address selected from said plurality of column addresses in response to a logic state of the second zoom-position selection data from said command decoder means;

third multiplexer means for receiving a color sub-carrier signal and a frequency-divided color sub-carrier signal from the frequency divider, and providing one of the color sub-carrier signal or said frequency divided color sub-carrier signal in response to a logic state of the zoom control signal;

fourth multiplexer means for receiving a horizontal synchronizing signal and a frequency-divided horizontal synchronizing signal from the frequency divider, and providing one of the horizontal synchronizing signal or said frequency divided horizontal synchronizing signal in response to the logic state of the zoom control signal;

vertical counter means for receiving the selected row address from said first multiplexer means in accordance with a vertical synchronizing signal from the frequency divider and providing corresponding row-address data, by adding a number "1" to said selected row address provided from said first multiplexer means in response to the horizontal synchronizing signal or said frequency-divided horizontal synchronizing signal received from said fourth multiplexer means; and horizontal counter means for receiving the selected column address from said second multiplexer means in accordance with said horizontal synchronizing signal and providing corresponding column-address data, by adding a numeral "1" to said selected column address from said second multiplexer means in response to the color sub-carrier signal or said frequency-divided color sub-carrier signal received from said third multiplexer means.

2. An address circuit, comprising: processing means for receiving image magnification information and zoom position data and for outputting a zoom control signal and first and second zoom-position selection data;

first multiplexer means for providing a row address selected from a plurality of row addresses and a column address selected from a plurality of column addresses, in response to said first and second zoom-position selection data;

second multiplexer means for providing as a first output a color sub-carrier signal or a divided color sub-carrier signal, and for providing as a second output a horizontal synchronizing signal or a divided horizontal synchronizing signal, in response to the zoom control signal;

counter means receiving said first and second outputs, for responding to a first synchronization signal by generating row-address data corresponding to the row address selected, by incrementing the selected row address provided by said first multiplexer means in response to the second output received from said second multiplexer means, and for responding to a second synchronization signal by generating column-address data corresponding to the column address selected, by incrementing the selected column address provided by said first multiplexer means in response to the first output received from said second multiplexer means.

3. The address producing circuit for zoom function as set forth in claim 1, wherein said vertical counter means adds said numeral "1" to said selected row address each time said frequency-divided horizontal synchronizing signal is received from said fourth multiplexer means, and adds said number "1" to said selected row address every two times said horizontal synchronizing signal is received from said fourth multiplexer means.

4. The address producing circuit for zoom function as set forth in claim 1, wherein said horizontal counter means adds said numeral "1" to said selected column address each time said frequency-divided color sub-carrier signal s received from said third multiplexer means, and adds said number "1" to said selected column address every two times said color sub-carrier signal is received from said third multiplexer means.

5. The address producing circuit for zoom function as set forth in claim 4, wherein said vertical counter means adds said numeral "1" to said selected row address each time said frequency-divided horizontal synchronizing signal is received from said fourth multiplexer means, and adds said number "1" to said selected row address every two times said horizontal synchronizing signal is received from said fourth multiplexer means.

6. The address producing circuit for zoom function as set forth in claim 3, wherein said horizontal counter means adds said number "1" to said selected column address each time said frequency-divided color sub-carrier signal is received from said third multiplexer means, and adds said numeral "1" to said selected column address every two times said color sub-carrier signal is received from said third multiplexer means.

7. The address circuit as claimed in claim 2, wherein said first multiplexer means comprises:

a first multiplexer for receiving said first zoom-position selection data and said plurality of row addresses, and for providing said selected row address; and a second multiplexer for receiving said second zoom-position selection data and said plurality of column addresses, and for providing said selected column address.

8. The address circuit as claimed in claim 2, wherein said second multiplexer means comprises:

a first multiplexer for receiving said color sub-carrier signal and said divided color sub-carrier signal, and for providing said first output; and a second multiplexer for receiving said horizontal synchronizing signal and said divided horizontal synchronizing signal, and for providing said second output.

9. The address circuit as claimed in claim 2, wherein said counter means comprises:

a vertical counter for incrementing said selected row address in response to said second output and in response to a vertical synchronizing signal as said first synchronizing signal; and a horizontal counter for incrementing said selected column address in response to said first output and in response to said horizontal synchronizing signal as said second synchronizing signal.

10. The address circuit as claimed in claim 9, wherein said vertical counter increments said selected row address by adding a numeral "1" to said selected row address each time said divided horizontal synchronizing signal is received from said second multiplexer means as said second output, and increments said selected row address by adding said numeral "1" to said selected row address every two times said horizontal synchronizing signal is received from said second multiplexer means as said second output.

11. The address circuit as claimed in claim 9, wherein said horizontal counter increments said selected column address by adding a numeral "1" to said selected column address each time said divided color sub-carrier signal is received from said second multiplexer means as said first output, and increments said selected column address by adding said numeral "1" to said selected column every two times said color sub-carrier signal is received from said second multiplexer means as said first output.

12. The address circuit as claimed n claim 7, wherein said second multiplexer means comprises:

a third multiplexer for receiving said color sub-carrier signal and said divided color sub-carrier signal, and for providing said first output; and a fourth multiplexer for receiving said horizontal synchronizing signal and said divided horizontal synchronizing signal, and for providing said second output.

13. The address circuit as claimed in claim 12, wherein said counter means comprises:

a vertical counter for incrementing said selected row address in response to said second output and in response to a vertical synchronizing signal as said first synchronizing signal; and a horizontal counter for incrementing said selected column address in response to said first output and in response to said horizontal synchronizing signal as said second synchronizing signal.

14. The address circuit as claimed in claim 13, wherein said vertical counter increments said selected row address by adding a number "1" to said selected row address each time said divided horizontal synchronizing signal is received from said fourth multiplexer as said second output, and increments said selected row address by adding said numeral "1" to said selected row address every two times said horizontal synchronizing signal is received from said fourth multiplexer as said second output.

15. The address circuit as claimed in claim 14, wherein said horizontal counter increments said selected column address by adding a numeral "1" to said selected column address each time said divided color sub-carrier signal is received from said third multiplexer as said first output, and increments said selected column address by adding said numeral "1" to said selected column address every two times said color sub-carrier signal is received from said third multiplexer as said first output.

16. The address circuit as claimed in claim 12, wherein said counter means comprises:

a vertical counter for incrementing said selected row address by adding a numeral "1" to said selected row address each time said divided horizontal synchronizing signal is received from said fourth multiplexer as said second output, and increments said selected row address by adding said numeral "1" to said selected row address every two times said horizontal synchronizing signal is received from said fourth multiplexer as said second output; and a horizontal counter for incrementing said selected column address by adding a number "1" to said selected column address each time said divided color sub-carrier signal is received from said third multiplexer as said first output, and increments said selected column address by adding said number "1" to said selected column address every two times said color sub-carrier signal is received from said third multiplexer as said first output.

17. An address circuit, comprising:

command decoder means for producing a zoom control signal and first and second zoom-position selection data in response to reception of functional information;

first multiplexer means for receiving a plurality of row addresses, and providing a row address selected from said plurality of row addresses in response to the first zoom-position selection data;

second multiplexer means for receiving a plurality of column addresses, and providing a column address selected from said plurality of column addresses in response to the second zoom-position selection data;

third multiplexer means for receiving a color sub-carrier signal and a frequency-divided color sub-carrier signal, and providing one of the color sub-carrier signal or said frequency divided color sub-carrier signal in response to the zoom control signal;

fourth multiplexer means for receiving a horizontal synchronizing signal and a frequency-divided horizontal synchronizing signal, and providing one of the horizontal synchronizing signal or said frequency divided horizontal synchronizing signal in response to the zoom control signal;

vertical counter means for receiving the selected row address in accordance with a vertical synchronizing signal and providing corresponding row-address data, by adding a first value to said selected row address in response to the horizontal synchronizing signal or said frequency-divided horizontal synchronizing signal; and horizontal counter means for receiving the selected column address in accordance with said horizontal synchronizing signal and providing corresponding column-address data, by adding a second value to said selected column address in response to the color sub-carrier signal or said frequency-divided color sub-carrier signal.

18. The circuit of claim 17, wherein said vertical counter means adds said first value to said selected row address each time said frequency-divided horizontal synchronizing signal is received; and adds said first value to said selected row address every two times said horizontal synchronizing signal is received.

19. The circuit of claim 17, wherein said horizontal counter means adds said second value to said selected column address each time said frequency-divided color sub-carrier signal is received; and adds said second value to said selected column address every two times said color sub-carrier signal is received.

20. The circuit of claim 19, wherein said vertical counter means adds said first value to said selected row address each time said frequency-divided horizontal synchronizing signal is received; and adds said first value to said selected row address every two times said horizontal synchronizing signal is received.

21. An address circuit, comprising:

command decoder means for producing a zoom control signal and first and second zoom-position selection data derived from functional information;

first multiplexer means for receiving a plurality of row addresses, and providing a row address selected from said plurality of row addresses in response to the first zoom-position selection data;

second multiplexer means for receiving a horizontal synchronizing signal and a frequency-divided horizontal synchronizing signal, and providing one of the horizontal synchronizing signal or said frequency divided horizontal synchronizing signal in response to the zoom control signal; and vertical counter means for receiving the selected row address in accordance with a vertical synchronizing signal and providing corresponding row-address data, by adding a value to said selected row address in response to the horizontal synchronizing signal or said frequency-divided horizontal synchronizing signal.

22. An address circuit, comprising:

command decoder means for producing a zoom control signal and first and second zoom-position selection data derived from functional information;

first multiplexer means for receiving a plurality of column address, and providing a column address selected from said plurality of column addresses in response to the second zoom-position selection data;

second multiplexer means for receiving a color sub-carrier signal and a frequency -divided color sub-carrier signal, and providing one of the color sub-carrier signal or said frequency divided color sub-carrier signal in response to the zoom control signal; and horizontal counter means for receiving the selected column address in accordance with a horizontal synchronizing signal and providing corresponding column-address data, by adding a value to said selected column address in response to the color sub-carrier signal or said frequency-divided color sub-carrier signal.

23. An address generating process, comprising:

producing a zoom control signal and first and second zoom-position selection data in response to zoom commands and zoom-position data;

receiving a plurality of row addresses, and providing a row address selected from said plurality of row addresses in response to the first zoom-position selection data;

receiving a horizontal synchronizing signal and a frequency-divided horizontal synchronizing signal, and providing one of the horizontal synchronizing signal in response to the zoom control signal; and receiving the selected row address in accordance with a vertical synchronizing signal and providing corresponding row-address data by adding a first value to said selected row address in response to the horizontal synchronizing signal or said frequency-divided horizontal synchronizing signal.

24. The process of claim 23, further comprising:

receiving a plurality of column addresses, and providing a column address selected from said plurality of column addresses in response to the second zoom-position selection data;

receiving a color sub-carrier signal and a frequency-divided color sub-carrier signal, and providing one of the color sub-carrier signal or said frequency divided color sub-carrier signal in response to the zoom control signal; and receiving the selected column address in accordance with said horizontal synchronizing signal and providing corresponding column-address data by adding a second value to said selected column address in response to the color sub-carrier signal or said frequency-divided color sub-carrier signal.

* * * * *

UNITED STATES PATENT AND TRADEMARK OFFICE

CERTIFICATE OF CORRECTION

PATENT NO. : 5,107,254
DATED : April 21, 1992
INVENTOR(S) : Hoon-Sun Choi

It is certified that error appears in the above-indentified patent and that said Letters Patent is hereby corrected as shown below:

| | | |
|---|---|---|
| Column 6, | Line 53, | Change "s" to --is-- ; |
| Column 10, | Line 38, | After "signal", Insert --or said frequency divided horizontal synchronizing signal-- . |

Signed and Sealed this

Twenty-sixth Day of September, 1995

*Attest:*

*Attesting Officer*

BRUCE LEHMAN

*Commissioner of Patents and Trademarks*